US006527958B1

(12) United States Patent
Carli et al.

(10) Patent No.: US 6,527,958 B1
(45) Date of Patent: Mar. 4, 2003

(54) DEVICE FOR REDUCING WATER HARDNESS (SOFTENER) HAVING A RESINS EXHAUSTION SENSOR, AND WASHING MACHINE HAVING SAID DEVICE

(75) Inventors: Carlo Carli, Varese (IT); Emilio Cazzini, Lonate Ceppino (IT)

(73) Assignee: T & P S.p.A., Tradate (IT)

( * ) Notice: Subject to any disclaimer, the term of this patent is extended or adjusted under 35 U.S.C. 154(b) by 0 days.

(21) Appl. No.: 09/200,224

(22) Filed: Nov. 25, 1998

(30) Foreign Application Priority Data

Nov. 27, 1997 (IT) ..... TO97A01039

(51) Int. Cl.[7] ..... B01J 47/14

(52) U.S. Cl. ..... 210/670; 210/687; 210/741; 210/744; 210/86; 210/97; 210/104; 210/105; 210/190; 210/251

(58) Field of Search ..... 210/662, 687, 210/741, 744, 86, 90, 91, 96.1, 97, 104, 105, 190, 191, 251, 670; 68/13 R

(56) References Cited

U.S. PATENT DOCUMENTS 4,332,678 A * 6/1982 Spiegl ..... 210/86
4,737,275 A * 4/1988 Franks ..... 210/91
4,855,062 A * 8/1989 Oelbermann ..... 210/741

* cited by examiner

*Primary Examiner*—Ivars Cintins
(74) *Attorney, Agent, or Firm*—Levine & Mandelbaum

(57) ABSTRACT

A water softener for reducing water hardness, suitable for use in a household washing machine, in particular a dishwasher, has a container within which ionic exchange resins are housed, which reduce the degree of hardness of water contacting them, and apparatus for regenerating the softening efficiency of the resins. Mounted in the container are a sensor for checking a physical characteristic of the resins and, in response thereto, detecting the degree of exhaustion of said resins.

30 Claims, 4 Drawing Sheets

DEVICE FOR REDUCING WATER HARDNESS (SOFTENER) HAVING A RESINS EXHAUSTION SENSOR, AND WASHING MACHINE HAVING SAID DEVICE

BACKGROUND OF THE INVENTION

The present invention relates to a water softener for reducing water hardness, suitable for use in a household washing machine, in particularly a dishwasher, and to a control method for checking the degree of exhaustion of the water hardness reducing substance.

It is well-known that household washing machines operating with water, more particularly dishwashers, can be equipped with a device for decalcifying the washing and rinsing water, i.e. for reducing the degree of water hardness, so as to avoid otherwise likely calcareous scale deposits. Such a device is also known as a water softener. Calcareous scale deposits are caused by an extremely high quantity of calcium ions (Ca++) and magnesium ions (Mg++) contained in the washing water. Such a decalcifier exchanges both the calcium ions (Ca++) and magnesium ions (Mg++) contained in the water for sodium ions (Na+) contained in appropriate resins placed in the decalcifier.

Resins or other similar substances, herein called resins for simplicity's sake, become exhausted after a certain time of usage, i.e. their Na+ ions to be exchanged with Ca++ and Mg++ contained in the water are consumed. As a result, water will still flow through resins but substantially maintain its starting hardness. The higher the water hardness is, the faster the resins will become exhausted.

This drawback is prevented through a phase where resins are regenerated by introducing a water-salt solution (NaCl). This resins regeneration phase is generally executed for each wash cycle, thereby requiring that a considerable quantity of salt be used, and often requiring that it be introduced by the user. Moreover, greater water consumption also results.

It is well-known that with a view to reducing salt and water waste some washing machines are equipped with water hardness sensors by which resins regeneration is activated only when water hardness is not sufficiently reduced due to resins exhaustion. The sensors are used to measure the water resistivity and, from the results obtained through an electronic system, the resins regeneration will either be activated or not.

The foregoing system requires that electrodes be dipped in the water and electrically energized. Although a low voltage is applied to the sensors, there will always be a danger, because these sensors are in direct contact with water. Moreover, even if water hardness is reduced, nothing prevents a light calcareous layer from being deposited on the sensors before resins regeneration is activated, thus altering water hardness detection due to the additional calcareous resistivity. Such systems detect water hardness directly, whereas resin status is detected only indirectly. As a result, resins regeneration will sometimes be activated in instances where it is not yet required.

SUMMARY OF THE INVENTION

An object of the present invention is to overcome the aforementioned drawbacks and provide, in particular, a device for reducing water hardness, i.e., a softener, which is suitable for use in a household washing machine, in particular a dishwasher, wherein detection of exhaustion of the reducing substance is realized in a simple, safe, inexpensive and direct manner.

Within this framework, it is an object of the present invention to provide a device for reducing water hardness, i.e., a softener, which is suitable for use in a household washing machine, in particular a dishwasher, a control method to check the degree of exhaustion of the water hardness reducing substance, and a washing machine using such a device, all having the features of the annexed claims which form an integral part of the present description.

Further aims and advantages of the present invention will become apparent from the following detailed description and the annexed drawings, which are supplied by way of non limiting example, wherein:

DESCRIPTION OF THE PREFERRED EMBODIMENT

It should be noted that the present invention is based on the recognition that resins used to reduce water hardness tend to change their volume as they become exhausted. In other words, their physical status, i.e. either their volume or the force they are able to exert, if compressed in an environment having a fixed volume, will change according to their degree of exhaustion.

Figure 1:
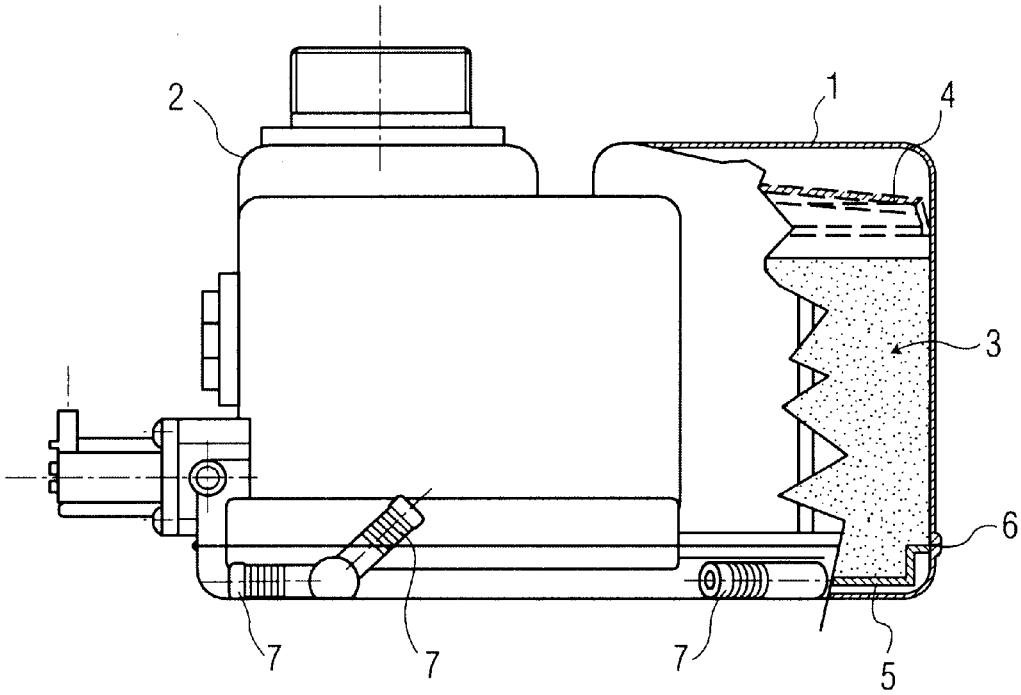
FIG. 1 PRIOR ART
FIG. 1 is a schematic view of a device for reducing water hardness according to the prior art.

In FIG. 1, where a water softener, i.e. a device for reducing water hardness according to the known state of the art, is schematically represented, reference numeral 1 indicates the resin container. Reference numeral 2 indicates a salt container for the regeneration of the resins. The two containers are mechanically and hydraulically connected to each other and the water softener is manufactured in two parts which are welded together through a hot-blade process, after various components have been assembled inside it. Reference numeral 3 indicates the water softening resins. Reference numeral 4 indicates an upper filter, Reference numeral 5 indicates a lower filter. Reference numeral 6 indicates the weld spot of both parts forming the water softener. And reference numeral 7 indicates various water pipelines.

Figure 2:
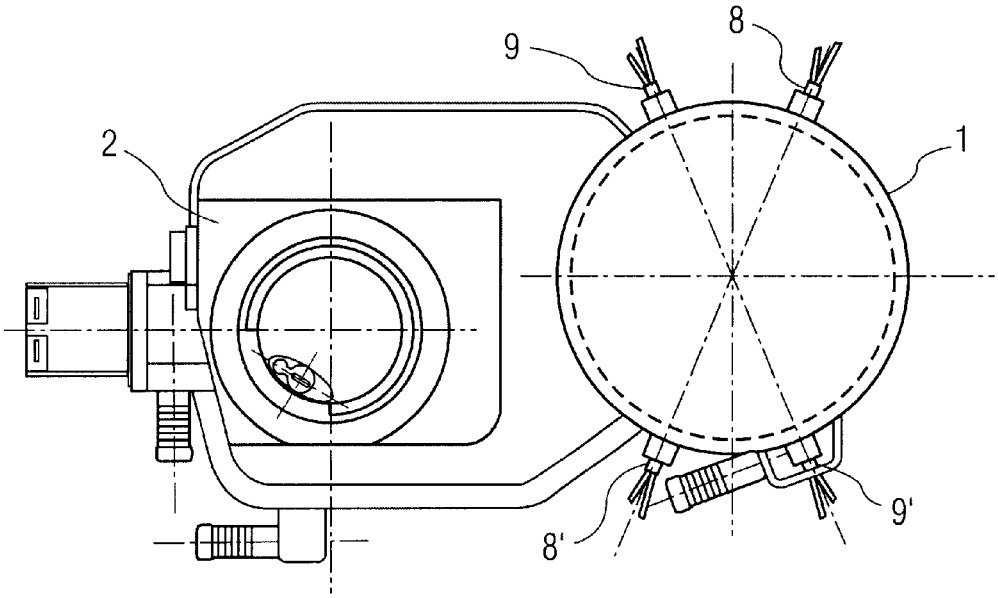
FIG. 2 is a plan view of a device for reducing water hardness having a sensor of a first type, to detect exhaustion of the resins used to reduce water hardness according to the present invention.
Figure 3:
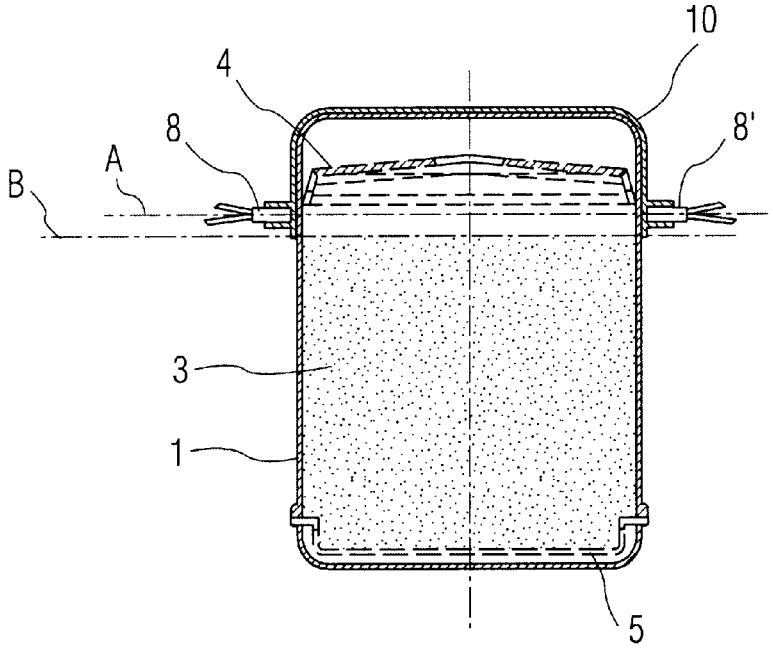
FIG. 3 is a sectional view of a device for reducing water hardness having a sensor of a first type, to detect exhaustion of the resins used to reduce water hardness according to the present invention.

FIGS. 2 and 3 show a plan view and a sectional view of a device for reducing water hardness, manufactured with a first type of sensor to detect exhaustion of the resins used to reduce water hardness according to the present invention. In FIGS. 2 and 3 the same reference numerals as per FIG. 1 are used to indicate common elements.

Reference numerals 8 and 8' indicate a pair of optical detectors arranged outside the body of the resins container 1, diametrically opposite to each other. Reference numerals 9 and 9' indicate a second pair of optical detectors arranged outside the body of the resins container 1, diametrically opposite to each other.

The two diameters, associated with the two pairs of sensors 8–8' and 9–9', have to be selected to have the largest area possible covered by the sensors, compatible with the overall dimensions of the decalcifier device. One sensor of pairs 8–8' and 9–9' is the light signal transmitter and the other sensor is the receiver. The sensors 8–8', 9–9' are arranged outside and in contact with the resins container 1. Their position and alignment, for correct operation, is ensured by a structure 10 which is fitted and fastened outside the resin container 1 and carries the seats for the sensors.

Line A indicates a first level reached by the resins in the container 1. The letter B indicates a second level reached by the resins in the container 1.

The first level A relates to the operating disposition of the resins in their original status, i.e. before being used for water softening, whereas the second level B represents the position of the resins after reaching a certain degree of exhaustion. In fact, as resins become exhausted, they undergo a volume reduction by 4–8% according to the type of resins used.

The pairs of optical detectors 8–8' and 9–9' have the function of checking the variation of the resins' height inside the container 1. When the height reaches a level where it can be determined that, for example, 70% exhaustion has been reached, then resins regeneration will be activated by the optical detectors conveniently arranged for such a height. Thus, the resins regeneration will only take place when required to avoid waste of water and salt. Additionally, this approach will never let the resins reach complete exhaustion with the consequent risk of using too hard water.

In order to obtain good operation of the optical detectors 8–8' and 9–9', the material used for the resin container may be a clear one. Alternatively, the resin container may be manufactured with clear inserts, just in the area where the optical detectors are located.

Since the resins level is not constant all along the perimeter, at least two pairs of optical detectors are required to carry out at least two detections and determine a mean level for the resins both in their natural status and exhaustion stage.

Figure 4:
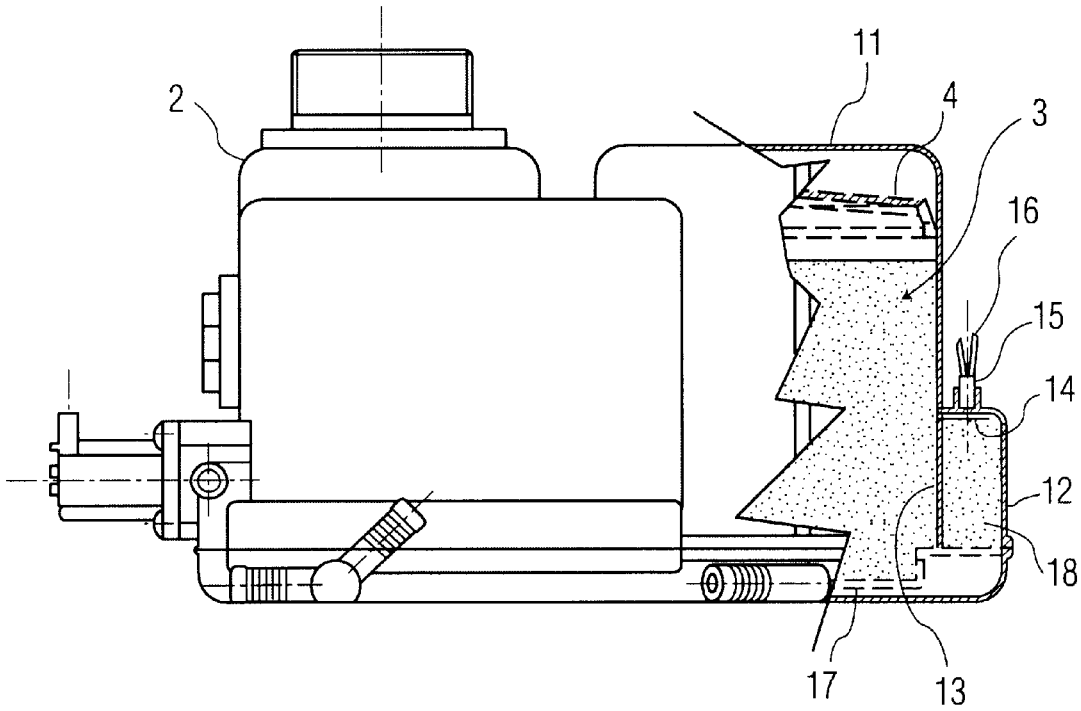
FIG. 4 is a partial sectional view of a first variant embodiment of a system for detecting exhaustion of the resins used to reduce the water hardness according to the present invention.

In FIG. 4, where a partial sectional view of a first variant embodiment of the detecting system for exhaustion of the resins for reducing the water hardness according to the present invention is represented, reference numeral 11 indicates a resins container and reference numeral 12 a space formed outside the container 11.

The space 12, has an open lower base, in correspondence with the joint line of the two parts of the container 11. A vertical wall of the space 12, indicated with reference numeral 13, is integral with the outside wall of the container 11 and has slits interconnecting the container 11 with the space 12.

Reference numeral 14 indicates a pressure sensor, for example of the piezoelectric type, arranged on the upper wall of the space 12 during the molding of the container 11. Reference numeral 15 indicates a transducer connected with the pressure sensor 14. Reference numeral 16 indicates connections, which may be wires or Faston terminals. Reference numeral 17 indicates a filter for the water entering the washing machine.

The space 12 is completely filled with a certain amount of sample resins, indicated with reference numeral 18, being of the same type of resins contained in the container 11. Resins 18 are introduced into the space 12 through its opening and maintained in position inside it by a portion of the filter 17, when the latter is welded to the above two parts forming the container. Welding is executed according to a so-called hot-blade welding process, i.e. both parts to be welded are melted together with a consequent height reduction of the vertical walls of the parts involved. As a result, resins 18 are compressed and fill up all the available room in the space 12, thereby exerting a pressure on the sensor 14.

When the water to be softened flows through the resins in the container 11, it also reaches the resins 18 contained in the space 12 through the holes of the filter portion closing the space 12. The water from the filter 17, flowing through the resins 18, then flows back to the container 11 through the slits defined on the wall 13 of the space 12. The slits are so dimensioned as to let water to flow through, but will not let any resins go through.

As the resins inside the container 11 become exhausted, their volume decreases as previously stated. The same happens for the resins contained in the space 12 as they also become exhausted and their volume decreases accordingly. This shrinking causes a change in the pressure exerted on the inner walls of the space 12 and consequently on the pressure sensor 14.

The pressure decreases as resin exhaustion continues, while the pressure sensor 14 decreases its electric polarization due to its own physical properties. Upon reaching a certain threshold, for example 70%, with reference to the pressure reached by the resins becoming exhausted, regeneration is activated.

Regeneration is activated under the control of an electronic control system, not shown in the drawings as already generally known, which detects the signal transmitted by the pressure sensor 14 through the transducer 15.

Since the pressure sensor 14 is in contact with water, its complete electrical insulation to water and resins is required to ensure correct operation.

It is obvious that many changes to the device for reducing water hardness are possible for the man skilled in the art, i.e., a softener suitable for use in a washing machine, in particular a dishwasher, having apparatus for detecting exhaustion of resins contained within the device described by way of example, without departing from the novelty and spirit of the inventive idea.

Figure 5:
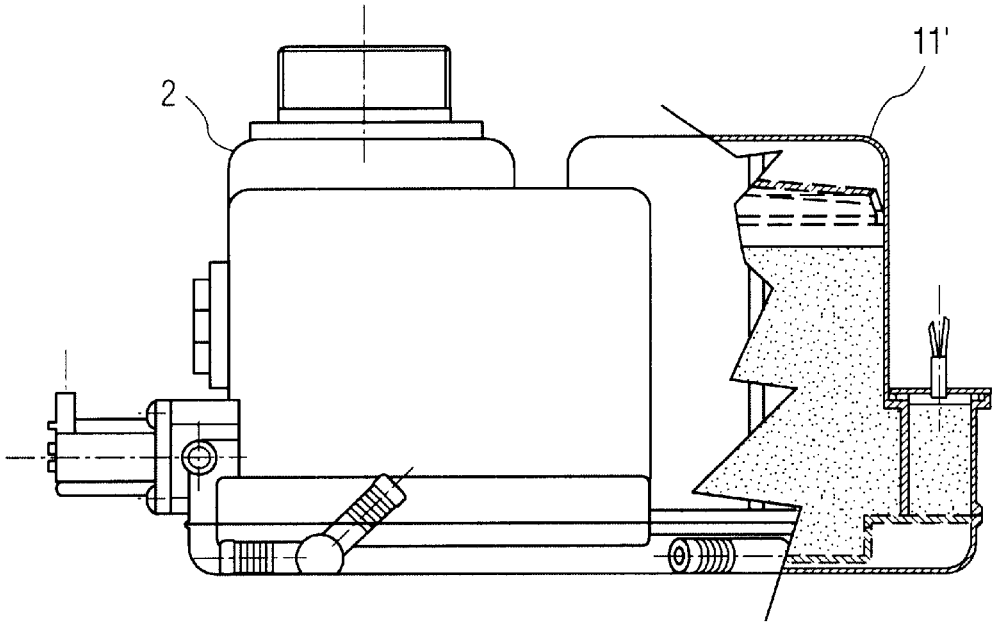
FIG. 5 is a partial sectional view of a second variant embodiment of a system for detecting exhaustion of the resins used to reduce water hardness according to the present invention.
Figure 6:
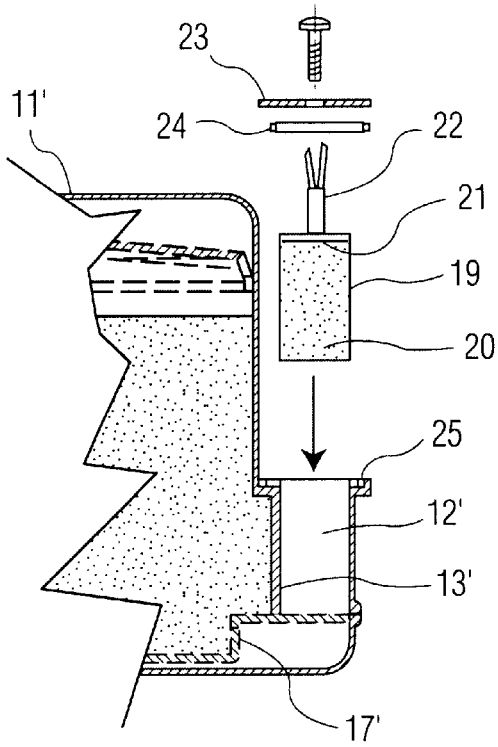
FIG. 6 is an exploded view of the second variant embodiment of the system for detecting exhaustion of the resins used to reduce water hardness according to the present invention.

A possible variant embodiment can be obtained using, for example, an interchangeable sensor, as represented in FIGS. 5 and 6, in order to overcome possible operating irregularities.

With reference to FIGS. 5 and 6, reference numeral 11' indicates a container for resins used to reduce water hardness, while reference numeral 12' indicates a space defined on a side of the container 11'. Reference numeral 17' indicates a lower filter of the container 11'. Reference numeral 13' indicates a wall of the space 12' which is a portion of the external wall of the container 11', being provided with some slits interconnecting the container 11' with the space 12'. As can be seen, the space 12' has both ends open. The lower end is closed by an extension of the filter 17', obtained as in the previous solution, during welding of both parts forming the container 11'.

Reference numeral 19 indicates a cage whose shape and dimensions allow for its insertion inside the recess 12', as shown in FIG. 5. Reference numeral 20 indicates a certain amount of sample resins in their natural granular status, i.e. similar to the resins housed in the container 11'. Reference numeral 21 indicates a pressure sensor with its relevant transducer 22 and electric wire or alternatively Faston terminal connections.

The cage 19 has an open side allowing a forced insertion of the pressure sensor 21 into a pre-existing hole on the upper side of the cage 19, and also allowing for filling the cage with the resins 20. The open side is then closed with a lid snap-fitted to the cage by means of small teeth, or welded in a known manner, for example by hot-blade welding. The amount of resins with which the cage is filled will cause their compression when closing the lid so that they exert a certain pressure on the sensor 21. The cage walls, save for the wall whereon the pressure sensor is located, have slits for allowing the passage of water, but hindering passage of the resins.

The cage 19 fitted with the pressure sensor and filled with resins is inserted into the space 12' formed on the body of the container 11'. The cage is kept inside the space 12' by a closure plug 23 which is screwed on the body of the space 12'. Hydraulic sealing is obtained by interposition of a gasket 24 of rubber or similar material, which is inserted in a seat 25 formed on the body of the space 12' between the plug 23 and the body of the space 12'. Operation is as previously described for the solution using a non-interchangeable pressure sensor.

According to a variant embodiment of the solution described above, a small block of resins compressed to a sodic form is used instead of granular resins, i.e. differing from the resins used in the container 11'.

Figure 7:
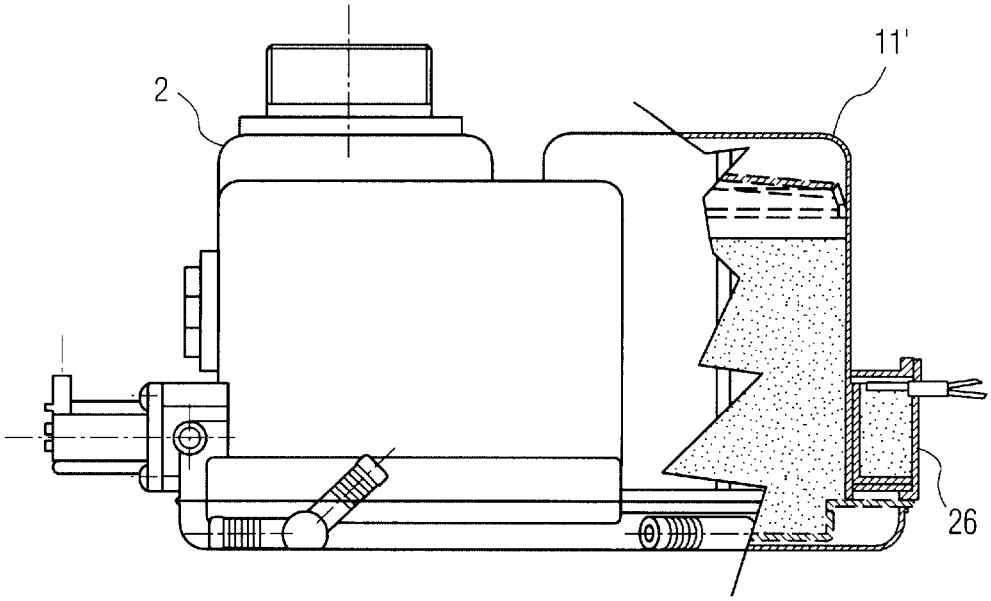
FIG. 7 is a partial sectional view of a third variant embodiment of a system for detecting exhaustion of the resins used to reduce water hardness according to the present invention.
Figure 8:
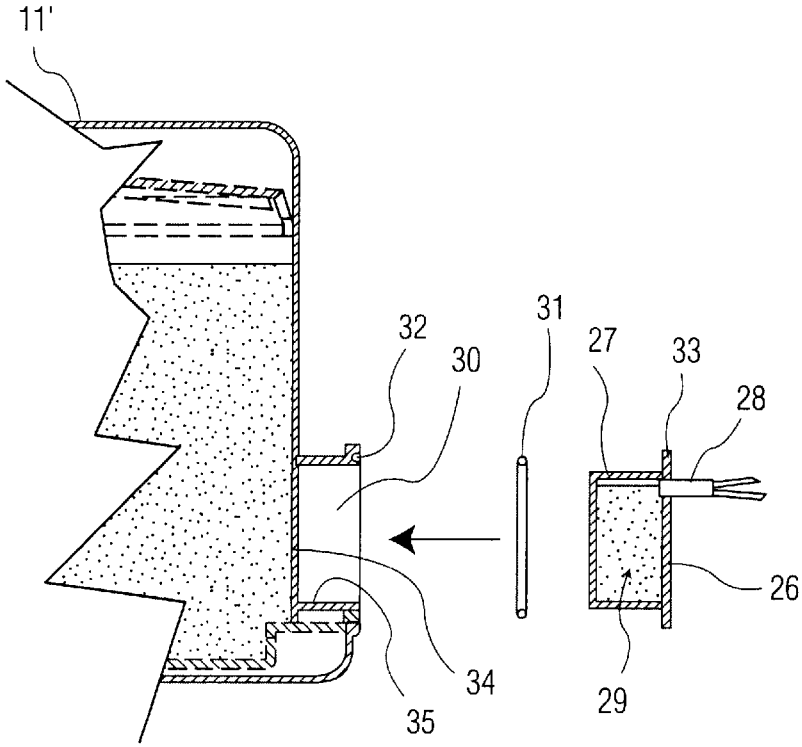
FIG. 8 is an exploded view of the third variant embodiment of a system for detecting exhaustion of the resins used to reduce water hardness according to the present invention.

A further variant embodiment, in order to make the sensor interchangeable, is represented in FIGS. 7 and 8 where the space for containing the pressure sensor with its respective resins is perpendicular to the body of the container 11' instead of being parallel to it. Also this variant embodiment is provided with a cage 26 containing a pressure sensor 27 and a transducer 28, along with its electric connections and resins 29.

In this case, the pressure sensor 27 is overmolded on a side of the cage 26, namely on its upper side, so that the connections come out perpendicular to a vertical side of the cage 26. The cage 26 has an open side for introduction of the resins 29, which is then closed with a small lid snap-fitted or welded by known processes, such as for example, a hot-blade welding. Also in this case, the resins are compressed within the cage 26 in order to exert a certain pressure on the sensor 27.

The cage 26 has slits on at least two walls, allowing the water to flow through, but hindering passage of the resins 29.

Reference numeral 30 indicates a space formed on the external wall of the container 11', for housing the cage 26. The recess 30 has slits on its bottom wall 34 and its lower wall 35, for allowing the water to flow from the bottom of the container 11' to the space 30 and inside the cage 26. Slits are also provided on the external wall of the container 11' as in the previous solutions.

The cage 26, complete with the sensor 27 and the resins 29, is housed in the space 30 and held in position by means of screws. Hydraulic sealing is obtained by means of a gasket 31 inserted in a throat 32 formed on the edge of the recess 30 whereon a flange 33 formed on the cage 26 rests. Also this solution can use a small block of resins compressed to a sodic form instead of granular resins, i.e. differing from the ones used in the container 11'.

The variant embodiments as represented in FIGS. 5–6 and 7–8 are practically similar and can be used depending on the water softener position on the washing machine, in order to ease the replacement of the sensor unit in case of malfunctioning.

As results from the above description, the detecting system for resins exhaustion in a washing machine is simple, has overall small dimensions and is easy to manufacture. Moreover, the device has a high operating reliability, since resins exhaustion is detected through a direct monitoring and does not require any water hardness control which would only give indirect indication of the degree of exhaustion of the resins themselves.

Additionally, the container where resins are housed also has a recess containing both the amount of sample resins and the exhaustion sensor, so that a further operational performance of the device is ensured. In fact, during operation, both the decalcifying resins and the sample resins are exposed to the same water temperature and pressure conditions so that the resins exhaustion signal resulting from the sample resins gets closer to reality. Moreover, easy replacement of a likely faulty sensor improves the performance of the softening device.

In view of an advantageous implementation of the present invention, the system may also be applied to detect and indicate if salt is lacking in the container 2.

A typical float system according to the present state of the art is reliable enough to switch off a signaling light after salt topping-up in the relevant container by the user. On the contrary, such a float system is often rather imprecise in signaling a lack of salt. Therefore, this variant embodiment is based on the idea of exploiting the volume increase and/or decrease of the softening resins, which to a certain extent is also bound to good performance of the brine used for resins regeneration.

In fact if the sensor, after having activated resins regeneration due to the fact that they have reached a set exhaustion degree, detects at the end of such a regeneration that the resins volume has not gone back to its initial values (as detected by the sensor either optically or because the pressure exerted by the resins on the pressure sensor has a lower value than expected for completely regenerated resins), then it can be concluded that the brine no longer has enough salt concentration to ensure a correct regeneration. As a result, the device controlling the sensor, i.e. an electronic control system as previously mentioned, will activate a light to warn the user that salt should be added to the container. Thus, the signal for salt topping-up occurs in a simple and reliable manner.

With reference to the embodiments of FIGS. 5 and 8 relating to the use of a pressure sensor, the possibility of using as sample resins (18, 20, 29), resins already in the exhausted form (calcic form) is mentioned. In other words, in this case the sample resins increase their volume only during the regeneration processes, thereby reducing limitations on the manufacturing process owing to the necessity to compress the sample resins (18, 20, 29) into the respective spaces, if they were to be used in the active form. In this case, detection of the resins exhaustion is signaled by an increase in the pressure of the sample resins on the pressure sensor, instead of a decrease of the pressure.

It is will be apparent that without prejudice to the principle of the present invention, many changes are possible to the construction features of the device for reducing water hardness, i.e., a softener suitable for the use in a washing machine, in particular a dishwasher, including a system for detection of exhaustion of the resins to reduce the water hardness as described by way of example, without departing from the novelty and spirit of the innovative idea. It is also clear that in the practical application of the invention, components may differ in form and size from the ones described and be replaced with technically equivalent elements.

What is claimed is:

1. A device for reducing water hardness, for use in a household washing machine, comprising a first container within which ionic exchange resins are housed, said resins being of the type capable of reducing the degree of hardness of the water contacting them, a second container, within which salt is contained for forming a brine, means for monitoring the quantity of salt within said second container, including sensor means for detecting the degree of exhaustion of said resins as a function of a volume variation of said resins, a control system for activating a regeneration of the softening efficiency of said resins, through said brine, when the degree of exhaustion of said resins, as detected by said sensor means, exceeds a predetermined threshold, said control system comprising indicating means responsive to said means for monitoring for indicating an insufficient quantity of salt within the second container in response to the volume variation of said resins, after a regeneration has occurred, being lower than a predetermined value.

2. A device according to claim 1 wherein said indicating means comprises signaling means for signaling a lack of salt within said second container, said control system being operative for activating said signaling means when the detected volume variation of said resins is lower than said predetermined value.

3. A device according to claim 1, wherein said sensor means comprises means for detecting a volume variation of a sample amount of said resins, said sample amount of resins being contained within said first container, the device comprising a further container, within which ionic exchange resins are housed for reducing the degree of hardness of the water contacting them, the quantity of resins contained within said further container being greater than the quantity of the resins of said sample amount contained in said first container.

4. A device according to claim 3 wherein the resins of said sample amount differ from the resins contained in said further container.

5. A device according to claim 1, wherein said sensor means are mounted on said first container.

6. A device according to claim 5, wherein said sensor means comprises a plurality of optical sensors, each of said optical sensors comprising a transmitter and a receiver.

7. A device according to claim 6, wherein said optical sensors are mounted on said first container.

8. A device according to claim 1, wherein said sensor means is an integral part of said first container.

9. A device according to claim 8, wherein said sensor means comprises a pressure sensor and a transducer operatively connected to said pressure sensor.

10. A device according to claim 9, wherein said pressure sensor detects the pressure exerted by a sample amount of resins.

11. A device according to claim 10, further comprising a compartment having a space containing said sample amount of resins, said compartment having at least one wall defining said space, said wall having an opening for being hydraulically connected to a further container.

12. A device according to claim 11 wherein said sample amount of resins is contained within said space.

13. A device according to claim 12, wherein said sensor means is disposed within said space.

14. A device according to claim 12 wherein said amount of sample resins is compressed within said space.

15. A device according to claim 12 further comprising a filter for constraining said resins within said container, wherein a wall of said compartment defining said space is formed by an extension of said filter.

16. A device according to claim 12 wherein a wall of the compartment defining said space comprises at least a portion of an external surface of said further container.

17. A device according to claim 16, further comprising a cage mounted within said compartment, said compartment being open on at least one of its front and its top for the insertion of said cage.

18. A device according to claim 11 comprising a cage arranged inside said space, said sample amount of resins being contained in said cage, said cage having slits for passage of water therethrough and said compartment comprising a seat for said cage.

19. A device according to claim 18, wherein said sensor means is disposed within said cage.

20. A device according to claim 18 wherein said amount of sample resins is compressed within said cage.

21. A device according to claim 18, further comprising fastening means mounted on said compartment to hold said cage within said space, said fastening means being selected from the group consisting of a closure plug for said space and a flange for said cage.

22. A device according to claim 21 wherein hydraulic sealing means is disposed between said compartment and said fastening means, said hydraulic sealing means comprising a gasket inserted in a throat formed on an external edge of said space.

23. A device according to claim 9 wherein said pressure sensor is a piezoelectric sensor.

24. A washing machine comprising a device for reducing water hardness, said device comprising a first container, within which ionic exchange resins are housed, said resins being of the type capable of reducing the degree of hardness of the water contacting them, sensor means, for detecting the degree of exhaustion of said resins as a function of a volume variation of said resins, a second container, within which salt is contained for forming a brine, means for monitoring the quantity of salt within said second container, and a control system responsive to said sensor means for activating a regeneration of the softening efficiency of said resins, through said brine, when the degree of exhaustion of said resins, as detected through said sensor means, exceeds a predetermined threshold, wherein said means for monitoring the quantity of salt within said second container comprises said sensor means, said control system detecting, through said sensor means after a regeneration has occurred, the volume variation of said resins, said control system further comprising signal means for indicating an insufficient quantity of salt within the second container in response to the volume variation of the resins being lower than a predetermined value.

25. A method for controlling the degree of exhaustion of the resins used for water softening in a household washing machine, comprising sensing a volume variation of water softening resins, said volume variation constituting an indication of the exhaustion degree of the softening power of said resins, and regenerating the resins by means of a water and salt solution, when the exhaustion degree of said resins, detected through said volume variation, exceeds a given threshold, wherein the quantity of salt necessary for performing an efficient regeneration process of said resins is monitored, by detecting the volume variation of said resins after a regeneration has occurred, comparing the volume variation of the resins detected after the regeneration has occurred with a predetermined value, and providing an indication that the quantity of salt is insufficient, in response to the volume variation of the resins detected after the regeneration has occurred being lower than the predetermined value.

26. A method according to claim 25, wherein said volume variation is sensed through a change of pressure exerted by said resins on a pressure sensor.

27. A method according to claim 25 wherein said volume variation is sensed directly through optical sensor means.

28. A control method according to claim 25, wherein the resin volume variation is sensed after each regeneration process.

29. A method according to claim 25 wherein the volume variation is sensed in only a sample amount of said resins.

30. A method according to claim 25, further comprising activating signaling means when the detected volume variation of said resins is lower than said predetermined value.

* * * * *